US011136099B2

(12) United States Patent
Chen et al.

(10) Patent No.: US 11,136,099 B2
(45) Date of Patent: Oct. 5, 2021

(54) UNDERWATER SCOOTER

(71) Applicant: E-LINK TECHNOLOGY CO.,LTD, Guangdong (CN)

(72) Inventors: Minyi Chen, Guangdong (CN); Pingzhi Li, Guangdong (CN); Xihui Jiang, Guangdong (CN); Yufeng Chen, Guangdong (CN)

( * ) Notice: Subject to any disclaimer, the term of this patent is extended or adjusted under 35 U.S.C. 154(b) by 0 days.

(21) Appl. No.: 16/808,385

(22) Filed: Mar. 4, 2020

(65) Prior Publication Data

US 2021/0171170 A1 Jun. 10, 2021

(30) Foreign Application Priority Data

Dec. 5, 2019 (CN) ..... 201911236772.4

(51) Int. Cl.
*B63C 11/46* (2006.01)
*A63B 35/12* (2006.01)

(52) U.S. Cl.
CPC ..... *B63C 11/46* (2013.01); *A63B 35/12* (2013.01)

(58) Field of Classification Search
CPC ..... B63C 11/00; B63C 11/46; A63B 35/00; A63B 35/08; A63B 35/12
USPC ..... 114/312, 313, 315, 321, 330, 331, 332, 114/337, 338
See application file for complete search history.

(56) References Cited

U.S. PATENT DOCUMENTS

| | | | | |
|---|---|---|---|---|
| 3,757,721 | A * | 9/1973 | Ohishi | A63B 35/12 114/315 |
| 9,295,880 | B2 * | 3/2016 | Mazin | A63B 35/12 |
| 2001/0025594 | A1 * | 10/2001 | Daniels | B63C 11/46 114/315 |
| 2005/0223961 | A1 * | 10/2005 | Iijima | B63C 11/46 114/315 |
| 2005/0252437 | A1 * | 11/2005 | Iino | B63C 11/46 114/315 |

* cited by examiner

*Primary Examiner* — Daniel V Venne
(74) *Attorney, Agent, or Firm* — ZanIP

(57) ABSTRACT

An underwater scooter includes a scooter body, a duct, a motor, and a propeller. The scooter body includes a body part, a side part defining a first through hole, and a plurality of stopping members disposed on an inner wall of the first through hole. A gap is defined between every two adjacent stopping members. The duct includes a surrounding member defining a second through hole, a supporting member connected to an inner wall of the surrounding member, and a plurality of engaging members disposed on an outer wall of the surrounding member and spaced apart from each other. Each of the plurality of engaging members passes through a corresponding gap between two adjacent stopping members and abuts against two opposite sides of a corresponding one of the plurality of stopping members after rotating with respect to the corresponding one of the plurality of stopping members.

20 Claims, 9 Drawing Sheets

UNDERWATER SCOOTER

CROSS REFERENCE TO RELATED APPLICATIONS

This application claims priorities to Chinese Patent Application No. 201911236772.4, filed on Dec. 6, 2019, the contents of which are herein incorporated by reference in their entireties.

TECHNICAL FIELD

The described embodiments relate to underwater equipment, and in particular to an underwater scooter.

BACKGROUND

Underwater scooter is a kind of underwater entertainment equipment for teenagers. A driver can easily and freely swim under water with a power provided by the underwater scooter. In addition, the underwater scooter provides good exercise to a developing balance system for young people.

However, since the underwater scooter is generally used in highly corrosive sea water, a motor of the underwater scooter needs to be maintained after a certain period of time, in order to extend a service life of the motor. However, the maintenance of the motor is time-consuming and laborious, which seriously affects normal development of underwater scooter.

SUMMARY

In some aspects, an underwater scooter may be disclosed. The underwater scooter may include a scooter body, a duct, a motor, and a propeller. The scooter body includes a body part, a side part disposed on the body part and defining a first through hole, and a plurality of stopping members disposed on an inner wall of the first through hole. A gap is defined between every two adjacent stopping members. The duct may include a surrounding member defining a second through hole, a supporting member connected to an inner wall of the surrounding member, and a plurality of engaging members disposed on an outer wall of the surrounding member and spaced apart from each other. Each of the plurality of engaging members passes through a corresponding gap between two adjacent stopping members and abuts against two opposite sides of a corresponding one of the plurality of stopping members after rotating with respect to the corresponding one of the plurality of stopping members. The motor is mounted on the supporting member; and the propeller is connected to an output end of the motor.

In some aspects, another underwater scooter may be disclosed. The underwater scooter may include a scooter body, a duct, a motor, and a propeller. The scooter body includes a body part, a side part disposed on the body part, and a plurality of stopping members disposed in the side part. The duct may include a surrounding member received in the side part, a supporting member received in the surrounding member, and a plurality of engaging members separately disposed on an outer wall of the surrounding member. Each of the plurality of stopping members is engaged in a corresponding one of the plurality of engaging members, and two opposite sides of each of the plurality of stopping members abut against the corresponding one of the plurality of engaging members. The motor is mounted on the supporting member; and the propeller is connected to an output end of the motor.

In some aspects, a housing for an underwater scooter may be disclosed. The housing play include a scooter body and a duct. The scooter body includes a body part, a side part disposed on the body part, and a plurality of stopping members disposed in the side part. The duct may include a surrounding member received in the side part, a supporting member received in the surrounding member, and a plurality of engaging members separately disposed on an outer wall of the surrounding member. Each of the plurality of stopping members is engaged in a corresponding one of the plurality of engaging members, and two opposite sides of each of the plurality of stopping members abut against the corresponding one of the plurality of engaging members.

BRIEF DESCRIPTION OF THE DRAWINGS

In order to make the technical solution described in embodiments of the present disclosure more clear, the drawings used for the description of the embodiments will be briefly described. Apparently, the drawings described below only belong to some embodiments of the present disclosure. For those skilled in the art, other drawings may be acquired based on these drawings without making any inventive work.

DETAILED DESCRIPTION

Figure 1:
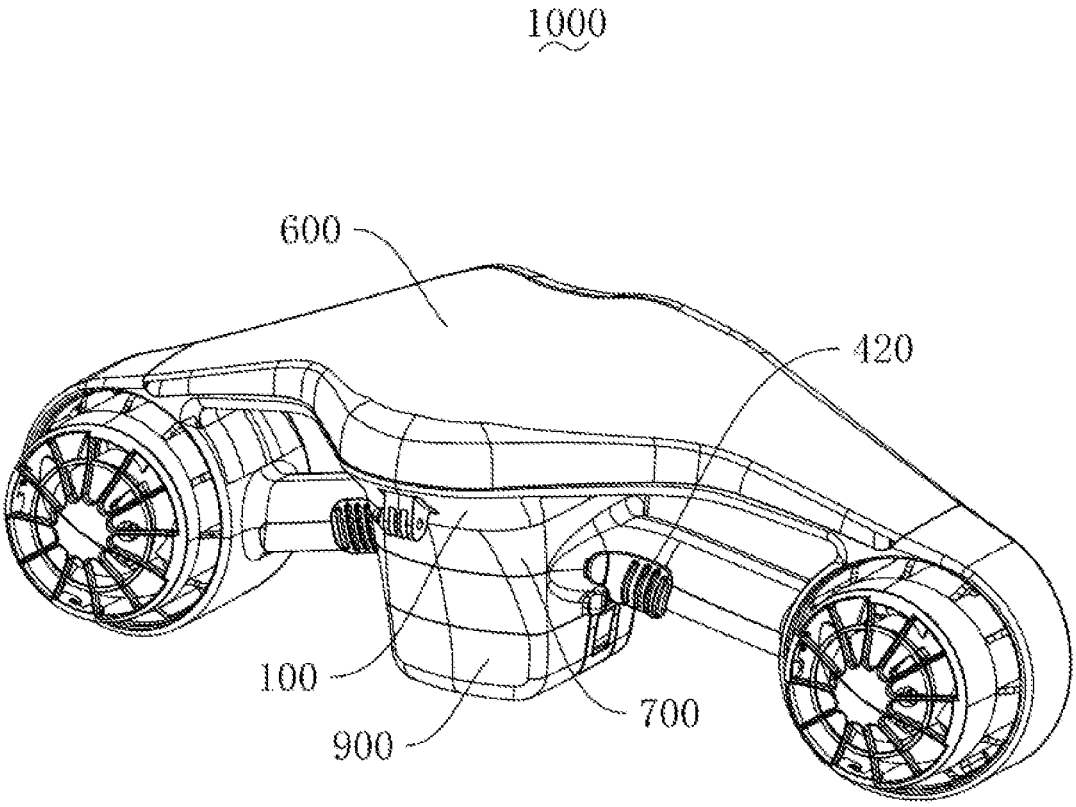
FIG. 1 is a schematic view of an underwater scooter according to some embodiments of the present disclosure.

Technical solutions in some embodiments of the present disclosure will be clearly and completely described in detail below with reference to the accompanying drawings in the embodiments of the present disclosure. It should be understood that, the specific embodiments described herein are only for purpose of illustration, rather than limitation. It should be further noted that, for convenience of description, parts of the structures related to the present disclosure, not all the structures, are shown. Based on the embodiments of the present disclosure, those skilled in the art may acquire other embodiments without any inventive work. All these belong to the protection scope of the present disclosure.

Further, the embodiments are described with reference to the accompanying drawings, in order to illustrate specific embodiments of the present disclosure that can be implemented. In the specification, it can be understood that, directional terms recited in the present disclosure, such as "upper", "lower", "inner", "outer", "side", or the like, refer to the orientations in the accompanying drawings. Thus, the directional terms used here are only for better and more clearly describing and understanding the present disclosure, and are not intended to indicate or imply that the devices or the elements are disposed to locate at the specific directions or are structured and performed in the specific directions, which could not to be understood as limiting the present disclosure. In the present disclosure, unless specified or limited, otherwise, terms "mounted", "connected", "disposed", "arranged", or the like are used in a broad sense, and may include, for example, fixed connections, detachable connections, or integral connections; may also be mechanical or electrical connections; may also be direct connections or indirect connections via intervening structures; may also be inner communications of two elements, as can be understood by those skilled in the art depending on specific contexts.

In addition, terms such as "first", "second", or the like are used herein for purposes of description, and are not intended to indicate or imply relative importance or significance or to imply the number of indicated technical features. Thus, the feature defined with "first", "second", or the like may include one or more of such a feature. In the description of the present disclosure, "a plurality of" means two or more unless specified otherwise. Moreover, the terms "comprise", "include" or any other variations thereof are meant to cover non-exclusive including, such that the process, method, article or device comprising a series of elements do not only include those elements, but also include other elements that are not explicitly listed or also include the inherent elements of the process, method, article or device. In the case that there are no more restrictions, an element qualified by the statement "comprises a . . . " does not exclude the presence of additional identical elements in the process, method, article or device that includes the said element.

"Embodiment" referred in the present disclosure means that a particular feature, structure, or characteristic described with reference to the embodiments may be included in at least one embodiment of the present disclosure. The term appearing in various places in the specification are not necessarily as shown in the same embodiment, and are not exclusive or alternative embodiments that are mutually exclusive with other embodiments. Those skilled in the art will understand explicitly and implicitly that the embodiments, described herein may be combined with other embodiments.

In some aspects, an underwater scooter may be disclosed. The underwater scooter may include a scooter body, a duct, a motor, and a propeller. The scooter body includes a body part, a side part disposed on the body part and defining a first through hole, and a plurality of stopping members disposed on an inner wall of the first through hole. A gap is defined between every two adjacent stopping members. The duct may include a surrounding member defining a second through hole, a supporting member connected to an inner wall of the surrounding member, and a plurality of engaging members disposed on an outer wall of the surrounding member and spaced apart from each other. Each of the plurality of engaging members passes through a corresponding gap between two adjacent stopping members and abuts against two opposite sides of a corresponding one of the plurality of stopping members after rotating with respect to the corresponding one of the plurality of stopping members. The motor is mounted on the supporting member; and the propeller is connected to an output end of the motor.

In some embodiments, each of the plurality of engaging members comprises at least two engaging portions staggered with each other, the at least two engaging portions define a channel, and the corresponding one of the plurality of stopping members is engaged in the channel.

In some embodiments, the body further includes a limiting portion, the limiting portion is disposed at one side of each of the plurality of stopping portions; one of the at least two engaging portions abuts against the limiting portion.

In some embodiments, each of the plurality of stopping portions defines a first fastening hole, and each of the plurality of engaging members comprises a fastener and defines a second fastening hole; the fastener runs through the first fastening hole of the corresponding one of the plurality of stopping members and is inserted into the second fastening hole of a corresponding one of the plurality of engaging members.

In some embodiments, the underwater scooter further includes a protective cover. The protective cover includes: a hollow part, defining a plurality of perforations and connected to an end of the surrounding member, and a fixing part, engaged with the surrounding member.

In some embodiments, the duct further comprises a positioning post disposed on the surrounding member; the fixing part defines a positioning groove, the positioning post passes through the positioning groove, rotates with respect to the positioning groove, and is further engaged in the positioning groove.

In some embodiments, the underwater scooter further includes an upper shell and a lower shell, wherein the upper shell and the lower shell are disposed at two opposite sides of the body part; the upper shell, the body part, and the lower shell cooperatively defines a buoyancy chamber.

In some embodiments, the underwater scooter further includes a buckling assembly, rotatably connected to the lower shell; and a protective shell, buckled with the buckling assembly and configured to receive a battery that supplies power to the motor.

In some embodiments, the buckling assembly may include: a first shaft, connected to the lower shell; a rotating member, rotatably connected to the first shaft; a second shaft, connected to the rotating member; and a buckling member, rotatably connected to the second shaft and buckled with the protective shell. In response to the rotating member rotating, the second shaft rotates about the first shaft, such that the buckling member is driven to separate from the protective shell.

In some embodiments, the underwater scooter further includes a control handle, electrically connected to the motor and configured to control the motor to rotate; a mating member, connected to the lower shell and received in the buoyancy chamber; and a sliding latch, engaged with the mating member, extending through the lower shell, and configured to stop the control handle from moving.

In some embodiments, the mating member defines at least two sliding grooves. The sliding latch comprises a protrusion capable of sliding into the at least two sliding grooves.

In some embodiments, the sliding latch further includes: a touch portion, disposed outside the lower shell; and a stopping portion, connected to the touch portion and being capable of abutting against the control handle. The protrusion protrudes from the stopping portion.

In some aspects, another underwater scooter may be disclosed. The underwater scooter may include a scooter body, a duct, a motor, and a propeller. The scooter body includes a body part, a side part disposed on the body part, and a plurality of stopping members disposed in the side part. The duct may include a surrounding member received in the side part, a supporting member received in the surrounding member, and a plurality of engaging members separately disposed on an outer wall of the surrounding member. Each of the plurality of stopping members is engaged in a corresponding one of the plurality of engaging members, and two opposite sides of each of the plurality of stopping members abut against the corresponding one of the plurality of engaging members. The motor is mounted on the supporting member; and the propeller is connected to an output end of the motor.

In some embodiments, each of the plurality of engaging members comprises at least two engaging portions staggered with each other and defining a channel, and the corresponding one of the plurality of stopping members is engaged in the channel.

In some embodiments, the body further includes a plurality of limiting portions, each of the plurality of limiting portions is disposed at one side of a corresponding one of the plurality of stopping portions and abuts against one of the at least two engaging portions.

In some embodiments, the underwater scooter may further include a protective cover. The protective cover may include: a hollow part, defining a plurality of perforations and connected to the surrounding member; and a fixing part, defining a positioning groove. The duct further comprises a positioning post disposed on the surrounding member, and the positioning post is engaged in the positioning groove.

In some embodiments, the underwater scooter may further include an upper shell and a lower shell, wherein the upper shell and the lower shell are disposed at two opposite sides of the body part; the upper shell, the body part, and the lower shell cooperatively defines a buoyancy chamber.

In some embodiments, the underwater scooter may further include a buckling assembly, rotatably connected to the lower shell and including: a first shaft, connected to the lower shell; a rotating member, rotatably connected to the first shaft; a second shaft, connected to the rotating member; and a buckling member, rotatably connected to the second shaft and buckled with the protective shell; and a protective shell, buckled with the buckling assembly and configured to receive a battery that supplies power to the motor. In response to the rotating member rotating, the second shaft rotates about the first shaft, such that the buckling member is driven to separate from the protective shell.

In some embodiments, the underwater scooter may further include a control handle, electrically connected to the motor and configured to control the motor to rotate; a mating member, connected to the lower shell and received in the buoyancy chamber; and a sliding latch, slidably engaged with the mating member, extending through the lower shell, and configured to stop the control handle from moving.

In some aspects, a housing for an underwater scooter may be disclosed. The housing may include a scooter body and a duct. The scooter body includes a body part, a side part disposed on the body part, and a plurality of stopping members disposed in the side part. The duet may include a surrounding member received in the side part, a supporting member received in the surrounding member, and a plurality of engaging members separately disposed on an outer wall of the surrounding member. Each of the plurality of stopping members is engaged in a corresponding one of the plurality of engaging members, and two opposite sides of each of the plurality of stopping members abut against the corresponding one of the plurality of engaging members.

Figure 2:
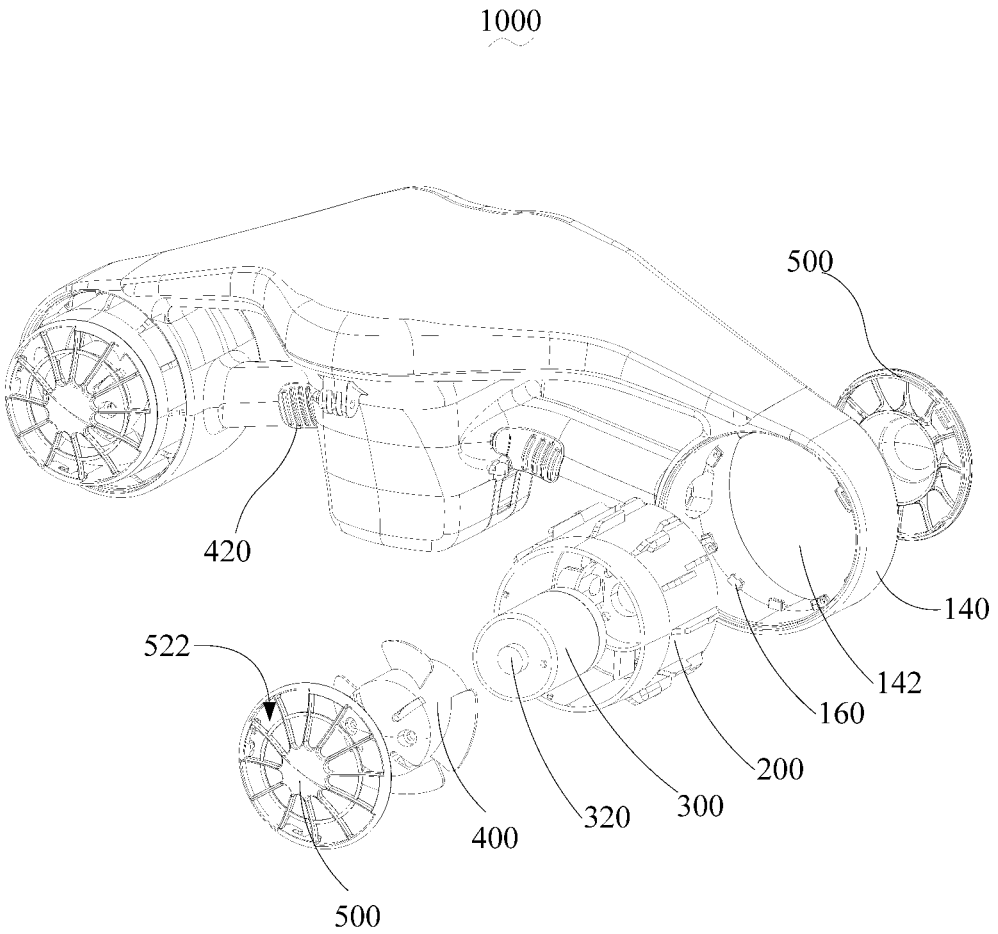
FIG. 2 is an exploded view of the underwater scooter according to some embodiments of the present disclosure.
Figure 3:
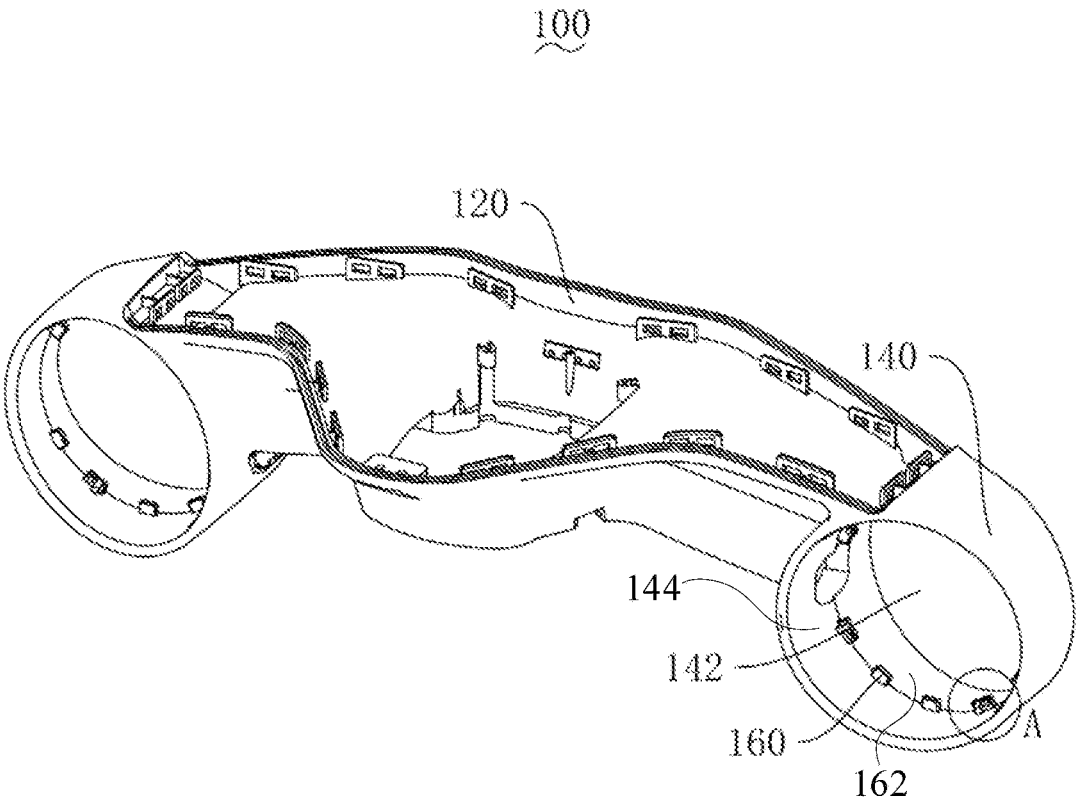
FIG. 3 is a schematic view of a scooter body according to some embodiments of the present disclosure.
Figure 4:
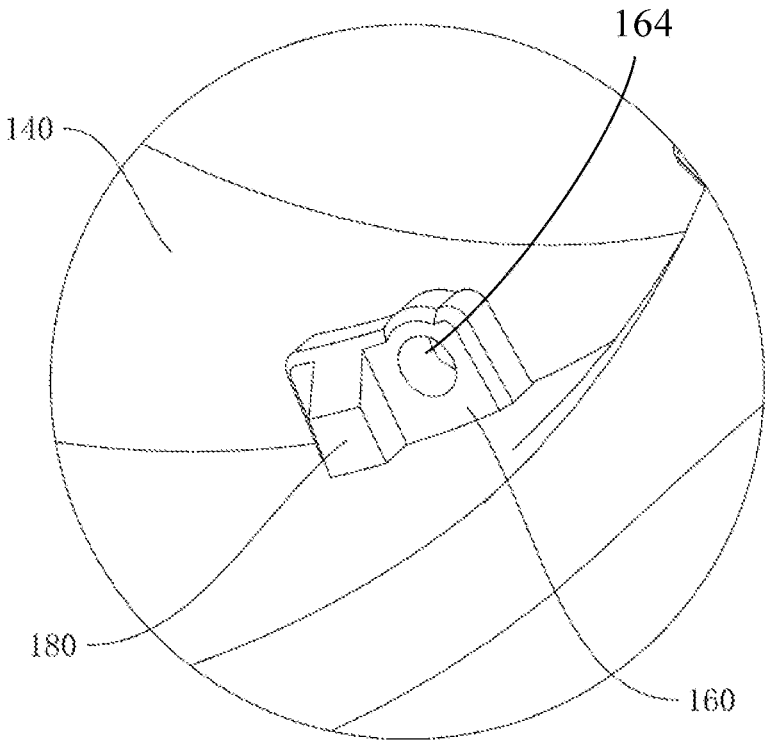
FIG. 4 is a partially enlarged view of an A region show in in FIG. 3 according to some embodiments of the present disclosure.
Figure 5:
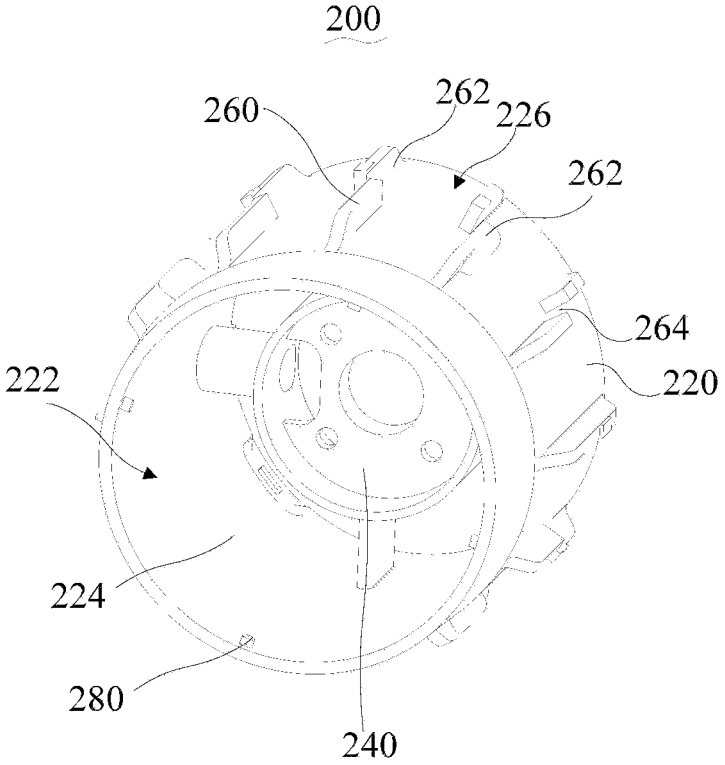
FIG. 5 is a schematic view of a duct according to some embodiments of the present disclosure.

FIG. 1 is a schematic view of an underwater scooter 1000 according to some embodiments of the present disclosure, FIG. 2 is an exploded view of the underwater scooter 1000 according to some embodiments of the present disclosure, FIG. 3 is a schematic view of a scooter body 100 according to some embodiments of the present disclosure, FIG. 4 is a partially enlarged view of an A region shown in FIG. 3 according to some embodiments of the present disclosure, and FIG. 5 is a schematic view of a duct 200 according to some embodiments of the present disclosure.

As show in FIGS. 1-2, in some embodiments of the present disclosure, the underwater scooter 1000 may include a scooter body 100, a duct 200, a motor 300, and a propeller 400. The duct 200 may be arranged or fixed on the scooter body 100. The motor 300 may be arranged or fixed in the duct 200. The motor 300 may include an output end 320 connected to the propeller 400. The motor 300 may be configured to drive the propeller 400 to rotate, such that the propeller 400 may rotate and push water to move. The water may in turn give a reaction force to the propeller 400, such that the underwater scooter 1000 is driven to move.

More specifically, as shown in FIG. 3, the scooter body 100 may include a body part 120, a side part 140, and a plurality of stopping members 160. The side part 140 may be disposed on the body part 120, and may define a first through hole 142, and the first through hole 142 may be configured to receive the duct 200. The side portion 142 may include an inner wall 144 defining or enclosing the first through hole 142. The plurality of stopping members 160 may be disposed on the inner wall 144 and spaced apart from each other along a circumference of the inner wall 144. In some embodiments, as shown in FIG. 4, each of the plurality of stopping members 160 may be a protrusion protruding from the inner wall 144 of the side part 140. A gap 162 may be defined between every two adjacent stopping members 160.

In some embodiments, a pair of ducts 200 may be provided, and the number of the motors 300 and the propellers 400 are equal to the number of the duct. The motors 300 and the propellers 400 are disposed or received in the corresponding ducts 200, as shown in FIGS. 1-2.

As shown in FIG. 3, a pair of side parts 140 may be provided. The pair of side parts 140 may be disposed on two opposite sides of the body part 120. Each of the pair of side parts 140 may define a first through hole 142, and may include an inner wall 144 defining or enclosing the first through hole 142. The pair of ducts 200 may be received in the first through hole 142 of the corresponding side part 140. The first through hole 142 may be substantially in shape of a circle. The plurality of stopping members 160 may be disposed on the inner wall 144 of each of the two side parts 140, and may be spaced apart from each other along a circumference of the inner wall 144 of each of the pair of side parts 140.

As shown in FIG. 5, the duct 200 may include a surrounding member 220 (also called as "outer frame" or "enclosing portion"), a supporting member 240, and a plurality of engaging members 260. The surrounding member 220 may enclose or surround to define a second through hole 224. An axis of the second through hole 224 may coincide with an axis of the first through hole 142. The supporting member 240 may be connected to an inner wall 222 of the surrounding member 220. The motor 300 may be received in the second through hole 224 and mounted on the supporting member 240. The propeller 400 may be configured to drive water to move directionally in the second through hole 224.

The plurality of engaging members 260 may be disposed on an outer wall 226 of the surrounding member 220 and spaced apart from each other along a circumference of the surrounding member 220. Each of the plurality of engaging members 260 may pass through a corresponding gap 162 between two adjacent stopping members 160. In addition, after each of the plurality of engaging members 260 rotates with respect to the plurality of stopping members 160, each of the plurality of engaging members 260 may abut against two opposite side surfaces of the corresponding stopping member 160. In this way, the duct 200 may be fixed with respect to the scooter body 100, thereby improving the efficiency of assembly, disassembly and maintenance of the duct 200.

Each of the plurality of engaging members 260 may include at least two engaging portions 262. The at least two engaging portions 252 may be staggered or misaligned with each other to define a channel 264. A corresponding stopping member 160 may be inserted or engaged in the channel 264, and the at least two engaging portions 262 may abut against the opposite sides of the corresponding stopping member 160. The specific assembly principles may be as follow. One of the at least two engaging portions 262 at one side of the channel 264 may pass the corresponding stopping member 160 (that is to say, the at least two engaging portions 262 may be disposed at two opposite sides of the corresponding stopping member 160 at this time), such that the channel 264 may face towards or align with the corresponding stopping member 160. At this time, the duct 200 may be rotated, the corresponding stopping member 160 may be inserted into the channel 264, and the at least two engaging portions 262 may abut against the two opposite sides of the corresponding stopping portion 160. In some embodiments, each of the plurality of stopping members 160 may fit into the channel 264 in an interference fit.

In the drawings of the present disclosure, two engaging portions 262 are shown. The two engaging portions 252 may be distributed at two opposite sides of the channel 264 and staggered or misaligned with each other to form the channel 264. Of course, in some embodiments, it is possible to provide three engaging portions 262. The three engaging portions 262 may be distributed at two opposite sides of the channel 264 and staggered or misaligned with each other to form the channel 264. For example, one insert 262 may be disposed at one side of the channel 264, and two engaging portions 262 may be disposed at the other side of the channel 264. The number of the engaging portions 262 may be other, which may be not listed here. The duct 200 may be an injection-molded part. The duct 200 may be injection-molded by a mold. The at least two engaging portions 262 may be staggered or misalign with each other, thereby facilitating the ejection of the engaging portions 262, reducing the use of sliders or inclined ejectors, and reducing a manufacturing cost of the mold.

As further shown in FIG. 4, the scooter body 100 may further include a limiting portion 180. The limiting portion 180 may be disposed at one side of each of the plurality of stopping portions 160. One of the at least two engaging portions 262 may abut against the limiting portion 180. In this way, it is possible to reduce the risk of rotating the duct 200 after the assembly has been finished.

Figure 6:
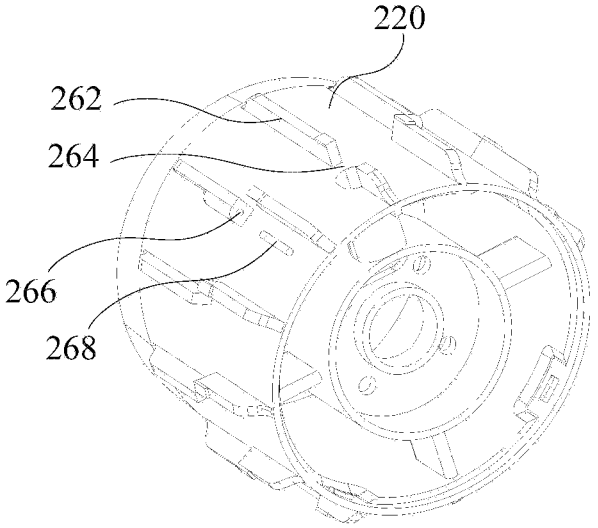
FIG. 6 is another schematic view of the duet according to some embodiments of the present disclosure.

As further shown in FIG. 4, each of the plurality of stopping portions 160 may further define a first fastening hole 164. Correspondingly, each of the plurality of engaging members 260 may further define a second fastening hole 266 and include a fastener 268, as shown in FIG. 6. When the duct 200 is mounted on the scooter body 100, an axis of the first fastening hole 164 may be aligned with an axis of the second fastening hole 266. The fastener 268 may run through the first fastening hole 164 of the stopping member 160 and be inserted into the second fastening hole 266, such that the duct 200 is fastened in the scooter body 100, thereby improving the stability of the assembly of the duct 200 and the scooter body 100.

Figure 7:
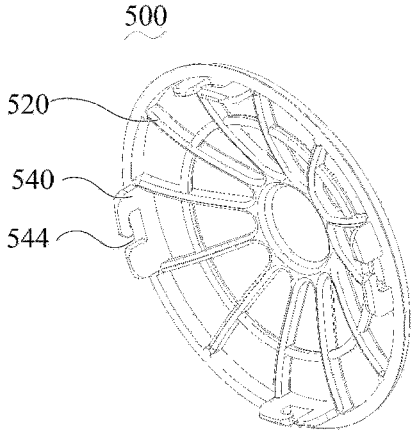
FIG. 7 is a schematic view of a protective cover according to some embodiments of the present disclosure.

FIG. 7 is a schematic view of a protective cover 500 according to some embodiments of the present disclosure.

As shown in FIGS. 2 and 7, the underwater scooter 1000 may further include a plurality of protective covers 500. More specifically, each duct 200 corresponds to a pair of protective covers 500. Each protective cover 500 may include a hollow part 520 and a fixing part 540. The hollow part 520 may be define a plurality of perforations 522. The hollow parts 520 of the pair of the protective covers 500 may be connected to two opposite ends of the surrounding member 220, and the fixing parts 540 of the pair of the protective covers 500 may be engaged with the surrounding member 220. Therefore, the protective covers 500 may be quickly fastened. When the propeller 400 needs to be cleaned, the protective covers 500 may also be quickly removed through the fixing part 540. The hollow part 520 may filter impurities on the premise of allowing water to pass through. In this way, it is possible to reduce the risk that the impurities wind around the propeller 400.

More specifically as shown in FIG. 5, the duct 200 may further include a positioning post 280. The positioning post 280 may be disposed on the surrounding member 220. The fixing part 540 may define a positioning groove 544. The positioning groove 544 may be substantially in an L shape. The positioning post 280 may pass through the positioning groove 544 and rotate with respect to the positioning groove 544. The positioning post 280 may be further engaged in or abut against a bottom of the positioning groove 544.

Figure 8:
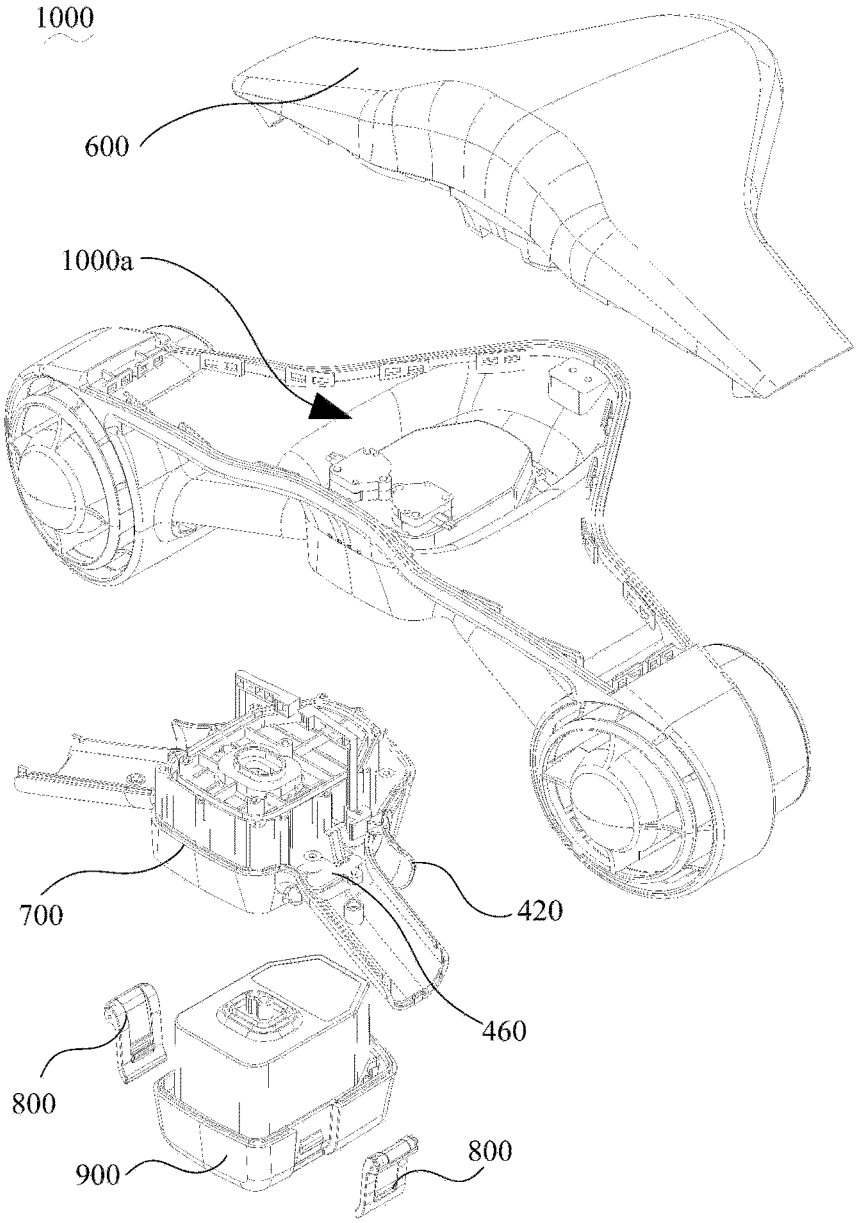
FIG. 8 is an exploded view of the underwater scooter according to some embodiments of the present disclosure.
Figure 9:
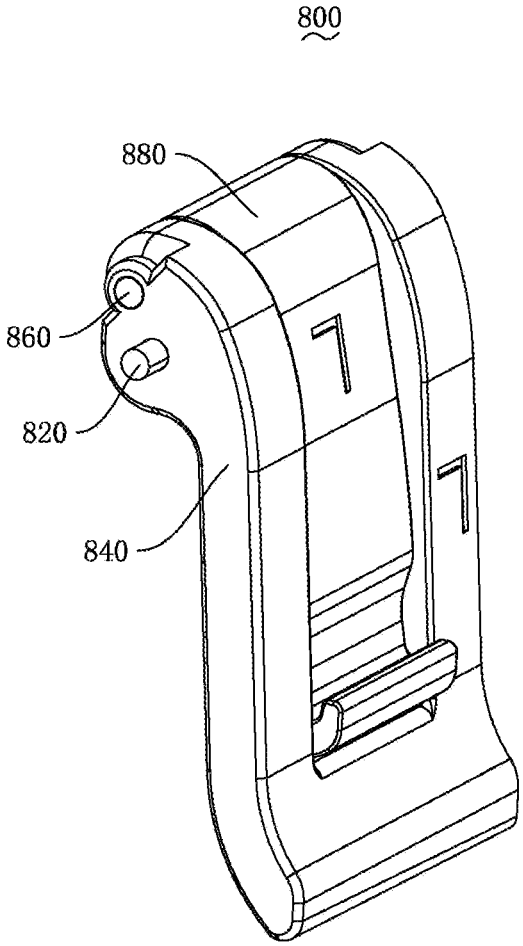
FIG. 9 is a schematic view of a buckling assembly according to some embodiments of the present disclosure.

As shown in FIGS. 8-9, FIG. 8 is an exploded view of the underwater scooter 1000 according to some embodiments of the present disclosure, and FIG. 9 is a schematic view of a buckling assembly 800 according to some embodiments of the present disclosure.

The underwater scooter 1000 may further include an upper shell 600 and a lower shell 700. The upper shell 600 and the lower shell 700 may be disposed at two opposite sides of the body part 120. The upper shell 600, the body part 120, and the lower shell 700 may cooperatively define a buoyancy chamber 1000*a*. The buoyancy chamber 1000*a* may suffer buoyancy under water to balance the weight of the underwater scooter 1000, thereby reducing a holding force of a user.

The underwater scooter 1000 may further include a buckling assembly 800 and a protective shell 900. The buckling assembly 800 may be rotatably connected to the lower shell 700. The buckling assembly 800 may be further buckled with the protective shell 900. The protective shell 900 may be configured to provide a space for placing a battery which supplies power to the motor 300, and protect the battery. The buckle assembly 800 may facilitate quickly replacing the battery.

More specifically, the buckling assembly 800 may include a first shaft 820, a rotating member 840, a second shaft 860, and a buckling member 880. The first shaft 820 may be connected to the lower shell 700. The rotating member 840 may be rotatably connected to the first shaft 820. The second shaft 860 may be connected to the rotating member 840. The buckling member 880 may be rotatably connected to the second shaft 860 and may be buckled with the protective shell 900. When the rotating member 840 rotates, the second shaft 860 may rotate about the first shaft 820. Thus, the buckling member 880 may be driven to separate from the protective shell 900.

In order to make those skilled in the art have a further understanding of the present disclosure, specific operations will be explained below. However, this will not constitute any limitation to the present disclosure.

The disassembly of the buckling member 880 from the protective shell 900 may include the following operations. The user may manually rotate the rotating member 840 clockwise about the first shaft 820. The second shaft 860 may rotate clockwise about the first shaft 820 under the driving of the rotating member 840. At this time, the buckling member 880 may move downward. Thus, the buckling member 880 may be separated from the protective shell 900. The assembly of the buckling member 880 and the protective 900 may include the following operations. The user may manually rotate the rotating member 840 counterclockwise about the first shaft 820. The second shaft 860 may rotate counterclockwise about the first shaft 820 under the driving of the rotating member 840. At this time, the buckling member 880 may move upward. Thus, the buckling member 880 may be buckled with the protective shell 900.

Figure 10:
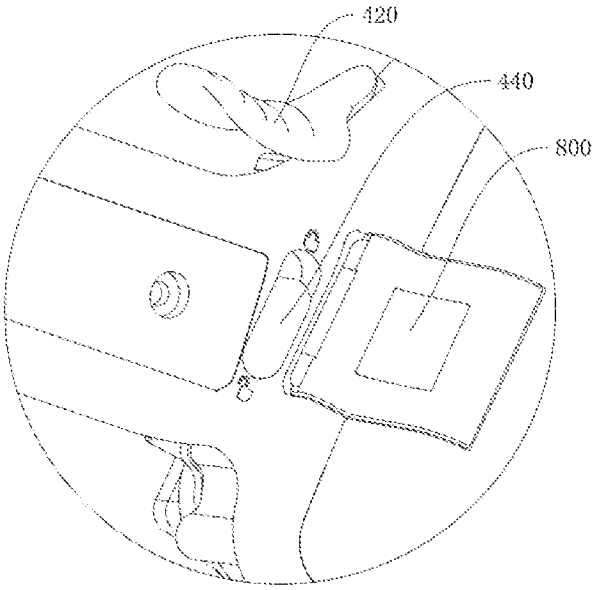
FIG. 10 is a partially enlarged view of an area of the underwater scooter in which a sliding latch is shown and viewed in an angle according to some embodiments of the present disclosure.
Figure 11:
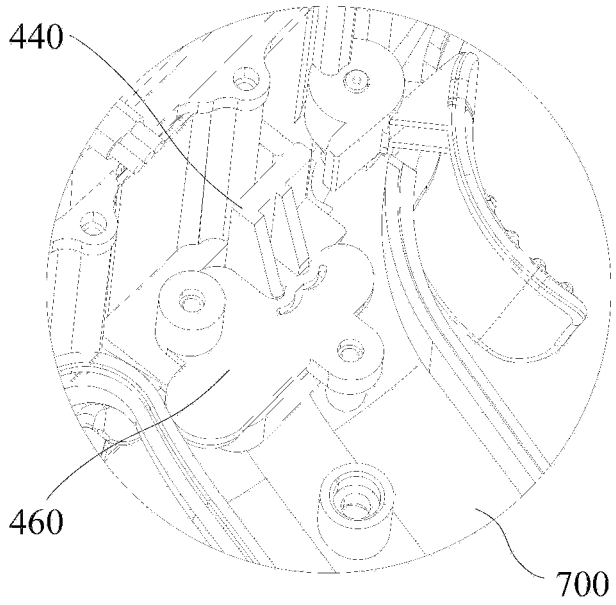
FIG. 11 is another partially enlarged view of the area of the underwater scooter in which the sliding latch and viewed in another angle is shown according to some embodiments of the present disclosure.

As shown in FIGS. 10-11, FIG. 10 is a partially enlarged view of an area of the underwater scooter 1000 in which a sliding latch 440 is shown and viewed in an angle according to some embodiments of the present disclosure, and FIG. 11 is another partially enlarged view of an area of the underwater scooter 1000 in which the sliding latch 440 is shown and viewed in another angle according to some embodiments of the present disclosure.

The underwater scooter 1000 according to some embodiments of the present disclosure may further include a control handle 420, a sliding latch 440, and a mating member 460. The control handle 420 may be implemented as a button, and may be electrically connected to the motor 300 to control the motor 300 to rotate. The mating member 460 may be connected to the lower shell 700, and may be received in the buoyancy chamber 1000*a*. The sliding latch 440 may be engaged with the mating member 460 and may extend through and further extend out of the lower shell 700. The sliding latch 440 may be configured to receive an external force to stop the control handle 420 from moving.

Figure 12:
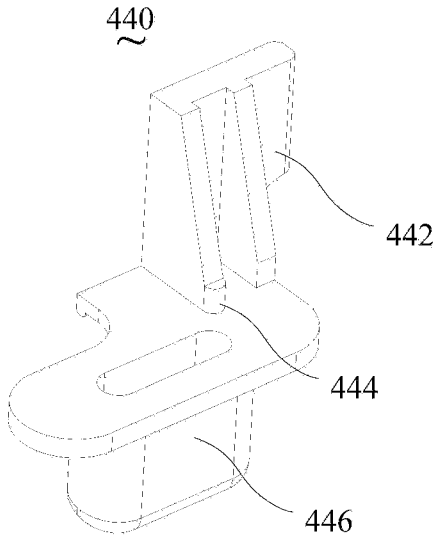
FIG. 12 is a schematic view of the sliding latch according to some embodiments of the present disclosure.

As further shown in FIG. 12, the sliding latch 440 may include a touch portion 442, a stopping portion 444, and a protrusion 446. The touch portion 442 may be disposed outside the lower shell 700, and is capable of being touched by the user. The stopping portion 444 may be connected to the touch portion 442, and is capable of abutting against the control handle 420, such that the control handle 420 may be stopped from moving. The protrusion 446 may protrude from the stopping portion 444. In some embodiments, the protrusion 446 may be substantially in shape of a semicircle.

Figure 13:
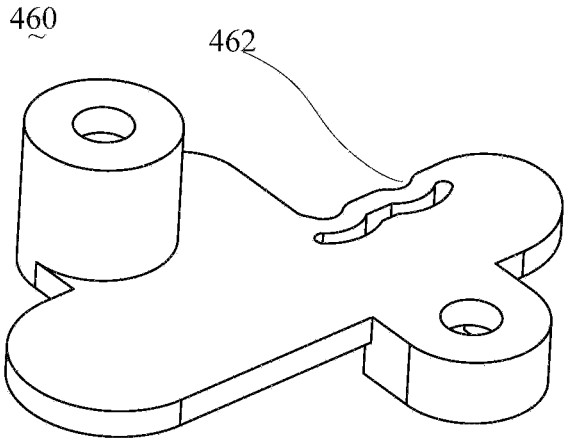
FIG. 13 is a schematic view of a second mating part according to some embodiments of the present disclosure.

As further shown in FIG. 13, the mating member 460 may define at least two sliding grooves 462. The protrusion 446 may have a shape matching with a shape of the protrusion 445, and may be capable of sliding into one of the sliding grooves at one moment.

More specifically, when the external force acts on the sliding latch 440, the sliding latch 440 may slide along the sliding grooves 462 of the mating member 460 and move toward the control handle 420 to stop the control handle 420. Besides, the sliding latch 440 may be engaged with the mating member 460, such that the sliding latch 440 may remain stationary. In this way, it is possible to effectively reduce the risk of initiating the underwater scooter 1000 by mistake.

Figure 14:
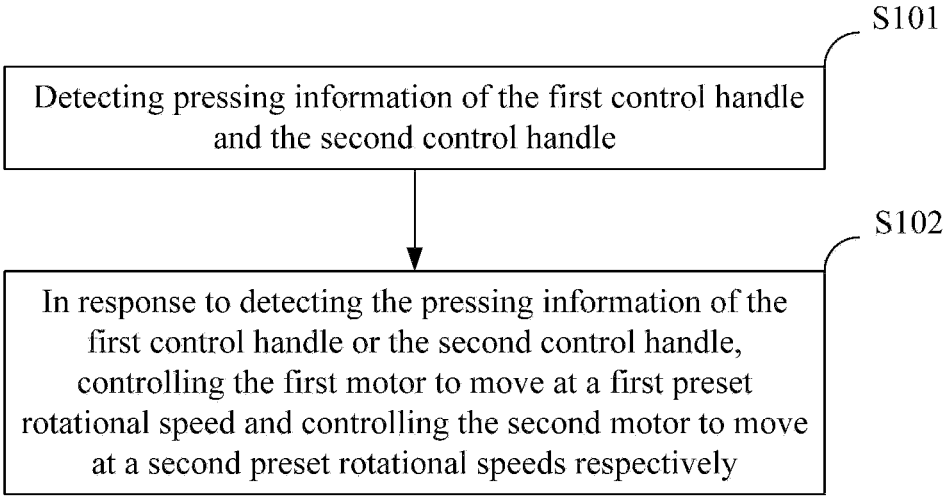
FIG. 14 is a flow chart of a method for controlling an underwater scooter according to some embodiments of the present disclosure.
Figure 15:
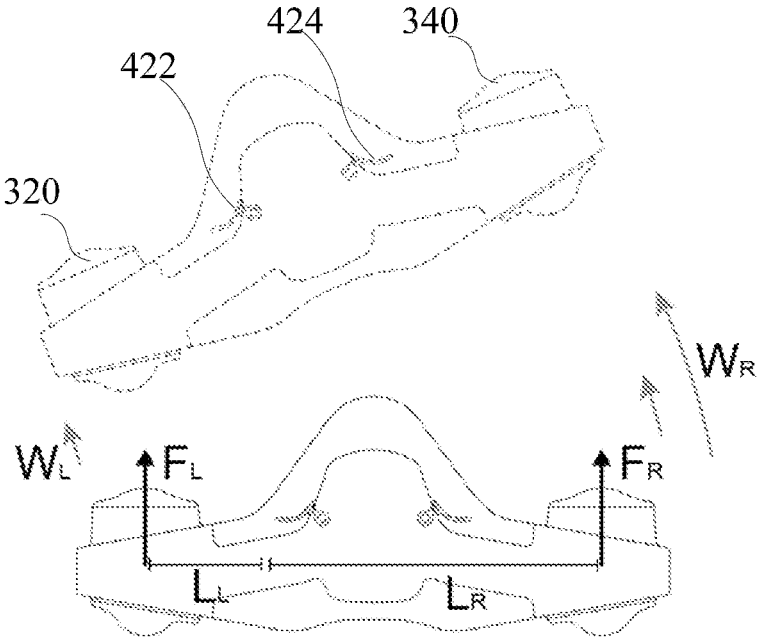
FIG. 15 is a schematic view of an underwater scooter according to some embodiments of the present disclosure.

As show in FIGS. 14-15, FIG. 14 is a flow chart of a method for controlling the underwater scooter 1000 according to some embodiments of the present disclosure, and FIG. 15 is a schematic view of the underwater scooter 1000 according to some embodiments of the present disclosure.

In some embodiments of the present disclosure, the method may be used to control the underwater scooter 1000 of any one of the foregoing embodiments. The motor 300 may include a first motor 320 and a second motor 340. The underwater scooter 1000 may further include a first control handle 422 electrically connected to the first motor 320 and a second control handle 424 electrically connected to the second motor 340. The method may include operations executed by the following blocks.

At block S101, pressing information of the first control handle 422 and the second control handle 424 may be detected. Herein, the pressing information refers to the information indicating the first control handle 422 or the second control handle 424 is pressed.

The underwater scooter 1000 may have at least three motion modes. The first motion mode is a two-handed operation mode. In the first mode, the user may press the first control handle 422 and the second control handle 424 with both hands, respectively. The first control handle 422 may control the first motor 320 to rotate, while the second control handle 424 may control the second motor 340 to rotate, thereby driving the user to move. The second motion mode is an one-handed operation mode. In the second mode, the user may press the first control handle 422 or the second control handle 424 with one hand. The first control handle 422 or the second control handle 424 may control the first motor 320 or the second motor 340 to rotate correspondingly, thereby driving the user to move. The third motion mode is a leisure mode. In the third mode, the user does not press the first control handle 422 and the second control handle 424 with his or her hands, and the first motor 320 and the second motor 340 may stop rotating. In this way, the user may move freely.

At block S102, in response to detecting the pressing information of the first control handle 422 or the second control handle 424, the first motor 320 may be controlled to move at a first preset rotational speed and the second motor 340 may be controlled to move at a second preset rotational speed respectively. In this way, it is possible to ensure that a torque of the underwater scooter 1000 may be zero.

The underwater scooter 1000 may monitor the pressing information of the first control handle 422 and the second control handle 424 in real time, and determine the motion mode of the underwater scooter 1000 in response to the pressing information. In response to detecting the pressing information of the first control handle 422 or the second control handle 424, the underwater scooter 1000 may enter the one-handed operation mode. For convenience of description, the user pressing the first control handle 422 may be taken as an example. In this case, a rotating point of the underwater scooter 1000 may fall on the first control handle 422, the torque is unbalanced, and a torque of the first motor 320 may be less than a torque of the second motor 340. In order to ensure that underwater scooter 1000 may continue straightly moving forward, the first motor 320 may be controlled to move at a first preset rotational speed and the second motor 340 may be controlled to move at a second preset rotational speed, and the first rotational speed of the first motor 320 may be greater than the second rotational speed of the second motor 340. In this way, it is possible to ensure that the first motor 320 and the second motor 340 may release preset forces, respectively, and a preset force released from the first motor 320 may be greater than a preset force released from the second motor 340, thereby ensuring that the torque of the underwater scooter 1000 may be zero. In this way, the underwater scooter 1000 may continue straightly moving forward without spinning. Thus, the underwater scooter 1000 may still normally move straightly in case that the user's hand is freed.

It should be noted that, the underwater scooter 1000 may also have other operation modes, such as a power-warning mode. In the power-warning mode, by controlling the rotational speed of the motor 300, the motor 300 may rotate for three times with its rotation speed changes to warn the user that the battery power is insufficient.

In the forgoing description, the above embodiments are merely exemplary implementations and are not intended to limit the scope of the present disclosure. Any equivalent structure or equivalent process transformation made by using the description and drawings of the present disclosure, or directly or indirectly applied to other related technology fields, shall be covered within a protection scope of the present disclosure.

What is claimed is:

1. An underwater scooter, comprising:

a scooter body, comprising:

a body part;

a side part, disposed on the body part and defining a first through hole; and a plurality of stopping members, disposed on an inner wall of the first through hole; wherein a gap is defined between every two adjacent stopping members;

a duct, comprising:

a surrounding member, defining a second through hole;

a supporting member, connected to an inner wall of the surrounding member; and a plurality of engaging members, disposed on an outer wall of the surrounding member and spaced apart from each other, wherein each of the plurality of engaging members passes through a corresponding gap between two adjacent stopping members and abuts against two opposite sides of a corresponding one of the plurality of stopping members after rotating with respect to the corresponding one of the plurality of stopping members;

a motor, mounted on the supporting member; and a propeller, connected to an output end of the motor.

2. The underwater scooter as claimed in claim 1, wherein each of the plurality of engaging members comprises at least two engaging portions staggered with each other, the at least two engaging portions define a channel, and the corresponding one of the plurality of stopping members is engaged in the channel.

3. The underwater scooter as claimed in claim 2, wherein the body farther comprises a limiting portion, the limiting portion is disposed at one side of each of the plurality of stopping portions; one of the at least two engaging portions abuts against the limiting portion.

4. The underwater scooter as claimed in claim 2, wherein each of the plurality of stopping portions defines a first fastening hole, and each of the plurality of engaging members comprises a fastener and defines a second fastening hole; the fastener runs through the first fastening hole of the corresponding one of the plurality of stopping members and is inserted into the second fastening hole of a corresponding one of the plurality of engaging members.

5. The underwater scooter as claimed in claim 1, further comprising a protective cover, the protective cover comprising:

a hollow part, defining a plurality of perforations and connected to an end of the surrounding member; and a fixing part, engaged with the surrounding member.

6. The underwater scooter as claimed in claim 5, wherein the duct further comprises a positioning post disposed on the surrounding member; the fixing part defines a positioning groove, the positioning post passes through the positioning groove, rotates with respect to the positioning groove, and is further engaged in the positioning groove.

7. The underwater scooter as claimed in claim 5, further comprising an upper shell and a lower shell, wherein the upper shell and the lower shell are disposed at two opposite sides of the body part; the upper shell, the body part, and the lower shell cooperatively defines a buoyancy chamber.

8. The underwater scooter as claimed in claim 7, further comprising:

a buckling assembly, rotatably connected to the lower shell; and a protective shell, buckled with the buckling assembly and configured to receive a battery that supplies power to the motor.

9. The underwater scooter as claimed in claim 8, wherein the buckling assembly comprises:

a first shaft, connected to the lower shell;

a rotating member, rotatably connected to the first shaft;

a second shaft, connected to the rotating member; and a buckling member, rotatably connected to the second shaft and buckled with the protective shell;

wherein in response to the rotating member rotating, the second shaft rotates about the first shaft, such that the buckling member is driven to separate from the protective shell.

10. The underwater scooter as claimed in claim 7, further comprising:

a control handle, electrically connected to the motor and configured to control the motor to rotate;

a mating member, connected to the lower shell and received in the buoyancy chamber; and a sliding latch, engaged with the mating member, extending through the lower shell, and configured to stop the control handle from moving.

11. The underwater scooter as claimed in claim 10, wherein the mating member defines at least two sliding grooves;

the sliding latch comprises a protrusion capable of sliding into the at least two sliding grooves.

12. The underwater scooter as claimed in claim 11, wherein the sliding latch further comprises:

a touch portion, disposed outside the lower shell; and a stopping portion, connected to the touch portion and being capable of abutting against the control handle;

wherein the protrusion protrudes from the stopping portion.

13. An underwater scooter, comprising:

a scooter body, comprising:

a body part;

a side part, disposed on the body part; and a plurality of stopping members, disposed in the side part;

a duct, comprising:

a surrounding member, received in the side part;

a supporting member, received in the surrounding member; and a plurality of engaging members, separately disposed on an outer wall of the surrounding member, wherein each of the plurality of stopping members is engaged in a corresponding one of the plurality of engaging members, and two opposite sides of each of the plurality of stopping members abut against the corresponding one of the plurality of engaging members:

a motor, mounted on the supporting member; and a propeller, connected to an output end of the motor.

14. The underwater scooter as claimed in claim 13, wherein each of the plurality of engaging members comprises at least two engaging portions staggered with each other and defining a channel, and the corresponding one of the plurality of stopping members is engaged in the channel.

15. The underwater scooter as claimed in claim 14, wherein the body further comprises a plurality of limiting portions, each of the plurality of limiting portions is disposed at one side of a corresponding one of the plurality of stopping portions and abuts against one of the at least two engaging portions.

16. The underwater scooter as claimed in claim 13, further comprising a protective cover, the protective cover comprising:

a hollow part, defining a plurality of perforations and connected to the surrounding member; and a fixing part, defining a positioning groove;

wherein the duct further comprises a positioning post disposed on the surrounding member, and the positioning post is engaged in the positioning groove.

17. The underwater scooter as claimed in claim 16, further comprising an upper shell and a lower shell, wherein the upper shell and the lower shell are disposed at two opposite sides of the body part; the upper shell, the body part, and the lower shell cooperatively defines a buoyancy chamber.

18. The underwater scooter as claimed in claim 17, further comprising:

a buckling assembly, rotatably connected to the lower shell and comprising:

a first shaft, connected to the lower shell;

a rotating member, rotatably connected to the first shaft;

a second shaft, connected to the rotating member; and a buckling member, rotatably connected to the second shaft and buckled with the protective shell; and a protective shell, buckled with the buckling assembly and configured to receive a battery that supplies power to the motor;

wherein in response to the rotating member rotating, the second shaft rotates about the first shaft, such that the buckling member is driven to separate from the protective shell.

19. The underwater scooter as claimed in claim 17, further comprising:

a control handle, electrically connected to the motor and configured to control the motor to rotate;

a mating member, connected to the lower shell and received in the buoyancy chamber; and a sliding latch, slidably engaged with the mating member, extending through the lower shell, and configured to stop the control handle from moving.

20. A housing for an underwater scooter, comprising:

a scooter body, comprising:

a body part;

a side part, disposed on the body part; and a plurality of stopping members, disposed in the side part;

a duct, comprising:

a surrounding member, received in the side part;

a supporting member, received in the surrounding member; and a plurality of engaging members, separately disposed on an outer wall of the surrounding member, wherein each of the plurality of stopping members is engaged in a corresponding one of the plurality of engaging members, and two opposite sides of each of the plurality of stopping members abut against the corresponding one of the plurality of engaging members.

* * * * *